United States Patent [19]

Steffinger

[11] Patent Number: 4,641,909

[45] Date of Patent: Feb. 10, 1987

[54] PLUG CONNECTOR

[75] Inventor: Karl Steffinger, Munich, Fed. Rep. of Germany

[73] Assignee: Siemens Aktiengesellschaft, Berlin and Munich, Fed. Rep. of Germany

[21] Appl. No.: 771,139

[22] Filed: Aug. 28, 1985

Related U.S. Application Data

[63] Continuation of Ser. No. 511,302, Jul. 6, 1983, abandoned.

[30] Foreign Application Priority Data

Jul. 21, 1982 [DE] Fed. Rep. of Germany ... 8220801[U]

[51] Int. Cl.[4] ..... H01R 13/514

[52] U.S. Cl. ..... 339/210 M

[58] Field of Search ..... 339/206 R, 206 P, 210 R, 339/210 M, 217 R, 217 PS, 220 R, 198 P, 111

[56] References Cited

U.S. PATENT DOCUMENTS

| | | | |
|---|---|---|---|
| 2,325,313 | 7/1943 | Gaty | 339/198 P |
| 2,925,577 | 2/1960 | Cetran et al. | 339/220 R |
| 2,998,589 | 8/1961 | Kulka | 339/217 R |
| 3,155,450 | 11/1964 | Filson | 339/210 R |
| 3,492,628 | 1/1970 | Matthews | 339/220 R |
| 3,764,955 | 10/1973 | Ward | 339/220 R |
| 3,858,163 | 12/1974 | Goodman et al. | 339/206 R |
| 3,897,131 | 7/1975 | Stauffer | 339/220 R |
| 3,945,705 | 3/1976 | Seim et al. | 339/210 M |
| 3,990,768 | 11/1976 | Faber | 339/210 R |

FOREIGN PATENT DOCUMENTS

| | | |
|---|---|---|
| 1490171 | 1/1969 | Fed. Rep. of Germany . |
| 1063077 | 3/1967 | United Kingdom . |

*Primary Examiner*—Gil Weidenfeld
*Assistant Examiner*—Gary F. Paumen
*Attorney, Agent, or Firm*—Hill, Van Santen, Steadman & Simpson

[57] ABSTRACT

A two piece housing plug connector of the type having multiple plug members received in bores in the housings with the plug members including socket ends for insertion of connectors at one end of the housing assembly and projecting plugs at the other end of the housing assembly, with the housing assembly parting along a line normal to the projection of the plugs and with antirotation axial movement locking means projecting from the plugs in the area of the part of the housing is provided with locking means designs effective to increase the current creepage path at the juncture line of the two housing halves. The locking means include projecting portions in each of the housing halves which are spaced from one another by an air gap substantially symmetrical to the parting line of the housing halves, the air gap having a distance which is at least as great as the effective length of the projecting locking means.

2 Claims, 2 Drawing Figures

PLUG CONNECTOR

This is a continuation of application Ser. No. 511,302, filed July 6, 1983, now abandoned.

BACKGROUND OF THE INVENTION

1. Field of the Invention

This invention relates to plug and socket assemblies, and more particularly to multi-plug, multiple piece housing assemblies.

2. Prior Art

Multi-plug and socket plug assemblies have achieved wide spread use in the electronics fields. A typical such assembly includes a housing member formed of an insulating material which contains a plurality of electrically conductive members having sockets at one end open to one side of the housing and projecting plugs at the other end projecting from the other side of the housing. The housing member is frequently formed as a two piece member with the pieces parting along a line normal to the projection of the plugs. The conductive members are received in aligned bores in the housing parts and may be provided with projections at the area of the parting line which are received in niche like expansion areas of the bores, the projections serving to lock the conductive members both axially and rotationally in the housing by means of engagement between the projections and the niche walls.

Such a plug member is known, for example, from British Pat. No. 1,063,077, German OS No. 14 90 171.

In order to reduce the size of the assembly, it is desired to provide the bores as close as possible to one another. To a certain extent, however, close packing is limited by the electrical creepage path which exists between the housing parts. By creating projections on the conductive members, particularly in the area of the split between the housing parts, the creepage path length between adjacent conductive members is reduced to the distance between the projections. In order to avoid problems encountered by the reduced creepage path, it has been known to sheath the conductive members, particularly in the area of the projections, with a hose like covering of insulating material before the conductive members are inserted into the bores of the electrically insulated housing. This, however, is a relatively involved method requiring additional components and additional assembly. It would be an appreciable advance in the art to provide the axial and rotational locking features in a manner which retains the simplicity of the projections but which does not adversely effect the creepage path length and which does not require additional components or assembly methods.

SUMMARY OF THE INVENTION

It is therefore the principal object of this invention to design a plug-socket member for multiple plug-socket assemblies wherein impermissible short current leakage paths can be avoided without employing additional insulating covers for the conductive members and where the conductive members can be adequately locked against axial and rotational movement.

This object is inventively obtained in that each of the conductive members is provided with two projections receivable in a niche like expansion of the housing bore adjacent the parting line of the housing parts with the two projections being separated from one another by an air gap symmetrical to the parting line, the air gap having a dimension normal to the parting line which is at least equal to the effective length of the projection parallel to the parting line at right angles to the plug-in direction.

In this manner, the creepage or current leakage path between adjacent conductive members in the area of the parting line not only consists of the distance along the parting line but also has an additional length component derived from the length of the air gap. Thus, the current leakage path between two neighboring conductive members is such that the shortening of the distance between the conductive members by reason of the projections has no effect on the path length.

In a further modification of the invention, the bores and their niche like expansion areas are conically expanded towards the parting line at least in the area of the air gap.

As a result, the current leakage path between two neighboring conductive members will be additionally lengthened thus improving the insulating characteristics of the multiple plug-socket assembly between adjacent conductive members.

It can also be provided within the framework of this invention that the projections of the conductive member are formed each by two tabs converging towards one another at their ends which project from the conductive member at right angles relative to the plug-in direction of the assembly with the tabs struck from the flat stock forming the conductive member and formed with the conductive member in a stamping-rolling process; or, the projections of the conductive member can be formed as two tabs that are bent out from the conductive member at right angles to the plug-in direction with the tabs lying in planes normal to the plug-in direction. In the first instance, the tabs have major faces lying parallel to the plug-in direction. As a third method, which is particularly useful in connection with non-flat stock formed conductive members, the projections can consist of non-round disks affixed to the outer surface of the conductive member and projecting therefrom parallel to the parting line, the disks being integrally connected to the conductive member either by being formed therewith or being attached thereto.

Any of these three preferred embodiments, and variants thereof, provide secure fitting of the socket-plug-in the housing members secured against both axial and rotational movement while being relatively uncomplicated and not adding significantly to the manufacturing or assembly costs.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
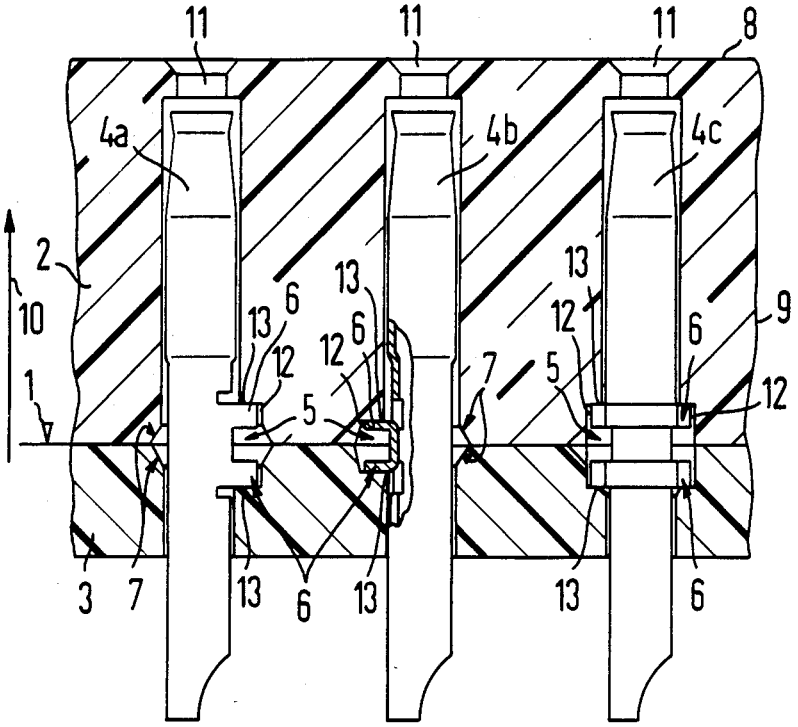
FIG. 1 is a greatly enlarged sectional view of a portion of a plug-socket assembly according to this invention showing three conductive members received in three housing bores.
Figure 2:
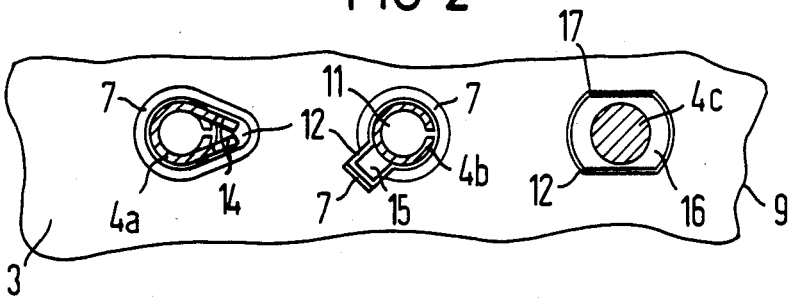
FIG. 2 is a sectional view taken substantially along the parting line of the housing portions of FIG. 1 looking upwardly.

FIG. 1 illustrates a plug-socket assembly of the type used in connection with another plug-socket assembly. Specifically, the type of assembly shown includes the plug-socket member 8 formed of an insulation material body 9 constructed of two housing parts 2 and 3. The plug-socket unit contains a plurality of connectors which are adapted to electrically connect with a mating plug-socket assembly. To this end, the assembly may be used with a plurality of leads connected to one end of a plurality of conductive members, the other ends forming sockets for receipt of pins from the mating assembly. Of course, conversely, the said other end could consist of projecting plugs which are to be received in sockets in the mating assembly.

The two housing parts 2 and 3 abut one another along a parting line 1 which is at substantially rights angles to the plug-in direction 10.

The insulating body 9 is provided with a plurality of parallel bores 11 extending through both housing parts 2 and 3 and spaced from one another by a specified distance. Each of the bores 11 contains a conductive member 4*a*, 4*b*, 4*c*, which, for example, can be effective as a spring contact.

In order to fix the individual conductive members 4*a*, 4*b* and 4*c* in the bores 11, the conductive members are provided with projections 6 which extend therefrom at right angles relative to the plug-in direction and to the axis of the conductive member. The projections 6 are integrally affixed to the conductive members.

The housing 9 is provided with niche-like expansions of the bores 11. The expansions 12 are dimensioned with respect to the projections such that the projections 6 are in contact with walls 13, the walls extending substantially at a right angle relative to the plug-in direction. Walls 13 are provided in both of the housing parts 2 and 3, contacting the outboard sides of the projections so as to firmly lock the conductive member axially in the bores. In this manner, one of the two parts 2 or 3 can first be provided with the conductive members 4*a*, 4*b* and 4*c*, and the other housing part can then be slipped over the conductive members and brought into assembled relationship with the first housing part. This simple assembly will serve to lock the conductive members axially in the bores. In order to maintain the proper locking of the conductive members in the bores, it is therefore only necessary that the parts 2 and 3 of the housing be held together. This can be accomplished in a great many different ways, for example, by means of screw type connections or by means of automatic resilient latches latching the two parts together upon installation.

Each of the conductive members are provided with two projections 6, the projections being separated from one another by an air gap 5 located in the area of the parting line 1 and symmetrical relative thereto. In the plug-in direction 10, the air gap 5 has a height between projections 6 which is at least as great as the effective length of the projection 6 at right angles relative to the plug-in direction. By providing such an air gap separating the two projections, and by providing that the air gap is symmetrical relative to the parting line, the distance from the sides of the projection facing the parting to the parting line in all cases will be combined with the distance of the parting line between adjacent bores, or bore niches, which ever is less, and therefore effective to increase the current linkage pathway between two neighboring conductive members since the pathway not only extends the distance of the parting line between the two conductive members, but also includes a length factor derived from the existence of the air gap.

Moreover, the niche 12 and expansion areas created thereby can, at least in the area of the air gap 5, be expanded conically, opening towards the parting line. The current path between neighboring conductive members is additionally lengthened by so doing.

It will be appreciated that the length of the air gap can, if desired, be greater than the effective projection distance of the projection 6.

Given a conductive member, for example, member 4*a* or 4*b*, which is manufactured in a stamping-rolling manufacturing technique, the projections can advantageously be formed by tabs which are stamped from or struck from the flat stock to be used to form the conductive member at the time of stamping of the conductive member and thereafter, during the rolling of the conductive member, be formed into projections. In the case of the conductive member designated 4*a*, each of the projections 6 comprises two tab members 14 which project tangentially from the curved periphery of the conductive member and whose ends are directed towards one another so that the tabs converge. In this example, the tabs 14 extend parallel to the plug-in direction. The projections 6 assymmetrically enlarge the circumference of the conductive member and, when locked in correspondingly formed niches, effectively provide an antirotation connection between the conductive member and the insulated housing 9.

Conductive member 4*b*, on the other hand, is provided with a single tab 15 which is bent out of the conductive member 4*b* in a plane proceeding at right angles relative to the plug-in direction 10 and is thus somewhat U-shaped in cross-section having top and bottom spaced legs forming the two projections 6. In this case, as in the case of 4*a*, the projections asymmetrically increase the circumference of the conductive member and therefore provide antirotation features when combined with an asymmetrically designed niche at the parting line.

Finally, in connection with conductive member 4, and similar conductive members which are formed of solid material, the projection 6 can be formed as disks 16 projecting at rights angles to the plug-in direction from the conductive member. By providing non-round projections having flats 17, the disk 16 can only be inserted in the bore 12 in two rotational positions which differ from one another by 180°, assuming, of course, that the niche or expansion of the bore is similarly shaped. Once again this provides an antirotation feature.

It will therefore be seen that this invention provides a plug connector assembly having an insulated housing with a plurality of bores therethrough for receipt of conductive members having at least one end projecting from the insulated housing, the insulated housing being formed of two portions which connect together along a parting line substantially at right angles to the bores, the bores being provided with diameter increasing sections at the parting line on both sides thereof and the conductive members being provided with diameter increasing projections receivable in the diameter increasing sections, there being at least two spaced projections for each conductive member, the projections lying substantially equally spaced to either side of the parting line and being separated from one another by an air gap, the air gap being dimensioned such that it provides a spacing between the projections normal to the air gap at least as great as the effective length of the projections parallel to the parting line, the projections being in contact with end walls of the diameter increasing sections of the housing to limit axial movement of the conductive members and the projections and diameter increasing members being dimensioned to restrict rotational movement of the conductive members.

Although the teachings of my invention have herein been discussed with reference to specific theories and embodiments, it is to be understood that these are by way of illustration only and that others may wish to utilize my invention in different designs or applications.

I claim as my invention:

1. In a plug-socket assembly having an insulated housing with a plurality of parallel bores therethrough, the housing being formed of two parts abutting one another along a parting line substantially normal to an axis of the bores with a plurality of cylindrically-shaped conductive members received in the insulated housing, one to a bore, the conductive members forming electrical contact plug-socket members with each of the conductive members having a diameter increasing projection received in a diameter increasing bore section effective to lock the conductive members axially in the bores, the improvement being the projections comprising at least two projections spaced axially along the conductive members separated by an air gap, the air gap having a dimension between the projections at least as great as the effective length of the projections in a direction normal to the bore axis and wherein the diameter increasing portion of the bore is configured with respect to the projections to provide wall surfaces for engagement by the projections preventing both axial and rotational movement of the conductive members and wherein the at least two projections of each of the conductive members being each formed by two tabs projecting therefrom, the tabs converging towards one another at free ends of the tabs, the tabs projecting from the conductive members tangentially from a curved periphery of said conductive members at right angles relative to the axis of the bores and extending in a plane parallel to the axis of the bores, the tabs being manufactured of flat stock in a stamping-rolling technique along with the formation of the conductive member, the conductive member being formed from flat stock in a stamping-rolling technique.

2. The improvement of claim 1, wherein the air gap is symmetrical to the parting line.

* * * * *